US006082614A

United States Patent [19]

Schmidt

[11] Patent Number: 6,082,614

[45] Date of Patent: Jul. 4, 2000

[54] PACKAGE FOR POURABLE GOODS

[75] Inventor: Ingolf Schmidt, Bremen, Germany

[73] Assignee: Kellogg Company, Battle Creek, Mich.

[21] Appl. No.: 09/254,191

[22] PCT Filed: Aug. 27, 1997

[86] PCT No.: PCT/EP97/04661

§ 371 Date: May 10, 1999

§ 102(e) Date: May 10, 1999

[87] PCT Pub. No.: WO98/08742

PCT Pub. Date: Mar. 5, 1998

[30] Foreign Application Priority Data

Aug. 30, 1996 [DE] Germany ..... 196 35 190

[51] Int. Cl.[7] ..... B65D 43/14

[52] U.S. Cl. ..... 229/123.3; 493/110; 53/412; 53/133.8; 53/242; 229/123.1; 229/125; 229/205; 220/269

[58] Field of Search ..... 229/123.3, 123.2, 229/123.1, 125, 200, 205; 220/268, 269; 493/110; 53/412, 133.8, 242, 561

[56] References Cited

U.S. PATENT DOCUMENTS

| | | | |
|---|---|---|---|
| 2,241,710 | 5/1941 | Lowey | 229/125.17 |
| 2,719,663 | 10/1955 | Meyer-Jagenberg | 229/132 |
| 2,757,851 | 8/1956 | Moore | 229/125.17 X |
| 2,828,061 | 3/1958 | Zerlin | 229/125.17 X |
| 2,858,060 | 10/1958 | Kuchler | 229/132 |
| 2,903,173 | 9/1959 | Hopkins | 229/123.3 |
| 2,970,736 | 2/1961 | Baughan | 229/125.17 X |
| 3,049,283 | 8/1962 | Buttery et al. | 229/123.2 |
| 3,187,977 | 6/1965 | Graybill | 229/123.3 |
| 3,215,329 | 11/1965 | Pugh, Sr. | 229/125.17 X |
| 3,298,593 | 1/1967 | Stephenson | 229/123.2 |
| 3,391,852 | 7/1968 | Waldrop | 229/123.3 |
| 4,209,126 | 6/1980 | Elias . | |
| 4,371,364 | 2/1983 | Rausing . | |
| 4,386,705 | 6/1983 | Meuller . | |
| 4,432,489 | 2/1984 | Cote . | |
| 4,583,679 | 4/1986 | Johnson | 229/123.3 X |
| 4,673,126 | 6/1987 | Hambelton . | |

FOREIGN PATENT DOCUMENTS

| | | |
|---|---|---|
| 757292 | 9/1956 | United Kingdom . |
| 8703536 | 6/1987 | WIPO . |

*Primary Examiner*—Stephen P. Garbe
*Assistant Examiner*—Tri M. Mai
*Attorney, Agent, or Firm*—Fulbright & Jaworski, LLP

[57] ABSTRACT

A packaging for bulk goods which comprises an inwardly laminated folded box body (1) and a lid (3), also of a laminated cardboard material, which is sealed or glued into position. In order to ensure the tightness of the packaging also in the corner regions, the coating also extends into said corner regions (7) of the lid (3). A pull-up window (4) is provided in the lid (3), while the package is filled from the lower side (2).

13 Claims, 4 Drawing Sheets

PACKAGE FOR POURABLE GOODS

The invention relates to a packaging for bulk goods which, once filled, is sealable and resealable to permit the withdrawal of bulk goods, which comprises a parallelepiped-shaped folded box body of laminated cardboard, in which a lid having side walls which are beaded or folded over through 90° is placed in position.

Such packaging for bulk goods is known in a design in which the top part of the folded box body is firmly and tightly connected to a beaded covering part, and comprises a discharge opening which is sealed so as to be resealable either only by means of wedging cover, or comprising a removable membrane in the opening.

In addition, beverage cartons having a folded box body are known and these are sealed by means of a beaded metal or plastics lid, holes being punched into said top part for withdrawal of the beverage.

In order to package pressure-sensitive loose bulk material, e.g. cereals, packages are known and these comprise an outer parallelepiped-shaped folded box, which is designed to be opened and then closed again via folded-over adhesive tongues. In order to protect the bulk goods against humidity and atmospheric oxygen, a bag of paper and/or plastics material is disposed within the folded box and simultaneously also provides an aromatic seal. Such packages comprising two parts do, however, have the drawback that the filling and finishing operations are complicated and thus costly while, on the other hand, it is not possible to fill the interior of the package sufficiently, because it is subsequently necessary for the previously filled and sealed bag to be pushed into the folded box. At present, however, such packages are the only manner in which it is possible for pressure-sensitive bulk goods to be packed so as to be substantially protected against pressure and to be tight to humidity and atmospheric oxygen.

The object underlying the present invention is to propose a packaging for bulk goods of the kind described at the outset, which is simple to fill, while having an increased filling capacity, and is designed to protect the package content against pressure, humidity and atmospheric oxygen.

According to the invention, this object is met in that the folded box body comprises a folded box blank, which is laminated with a sealing coat and is sealed or glued on one longitudinal overlapping seam, in that the folded box body has a feed opening which extends across the entire end surface on that end which is opposite the lid and which is sealed or glued once the package has been filled with the bulk goods, in that the lid comprises a pull-up window which is resealable, and in that the lid is inwardly provided with a sealing coat such that the corner regions between the folded-over side walls are also covered by the sealing coat, and the lid, together with its coating foil, is continuously sealed or glued tightly to the folded box body.

In a packaging of this kind, two different openings and seals are provided, i.e. a feed opening, which is as wide as possible and is used for originally filling said package, at one end of the package, whereas a discharge opening, which is resealable, is provided at the other end. The packaging according to the invention has the advantage that is comprises only a single package part, i.e. the folded box body together with the lid and, accordingly, does not require an additional inner bag. As a result of a corresponding design of the corner regions of the lid, it is possible to ensure an absolutely tight seal or glued connection with the corresponding end of the folded box body, because the sealing coat of the lid also extends into the corner regions, a feature which is usually not available in standard cardboard lid having side walls folded over through 90°.

In a packaging, in which the lid comprises a cardboard blank having lateral surfaces appended to a basic surface area via scoring and punched out corner regions, this tightness in the corner regions is achieved in that a thermoplastic foil, which covers the punched-out corner regions, is applied to this blank. When the folded box body is also laminated with a corresponding thermoplastic foil, it is possible for the lateral surfaces, including the corner regions, to be sealed or glued firmly and tightly to the inwardly laminated folded box body.

The pull-up window, which is defined by tearing perforations and scoring, is provided in the basic surface area for discharging the content of bulk goods. Said tearing perforations are punched in prior to the application of the thermoplastic foil, such that the thermoplastic foil, disposed over these regions, ensures a perfect sealing in these regions. In order to facilitate the tearing of the pull-up window, the thermoplastic foil applied to the lid preferably has a monoaxial orientation in the tearing direction of the pull-up window. The machining direction of the carton/lid preferably also extends parallel to the pull-off perforation.

The pull-up window preferably extends over about one half of the lid in the longitudinal direction, into an adjoining narrow side wall of the lid, and a scoring is provided in the central region in a transverse direction of the lid. Two lines of tearing perforations, which start from said scoring, extend with a spacing therebetween up to said narrow side wall. A pulling tab, by means of which it is possible for the pull-up window to be torn open quite readily up to the scoring, which extends in the central region in a transverse direction to the lid, and then tilted upward, is shaped on this narrow side wall via a further scoring. When certain of the content has been discharged, it is then possible for the pull-up window to be tilted down again, thereby closing the packaging, although this closure will not have a high degree of tightness.

A further advantageous embodiment is characterized in that, in the region of the further scoring between the narrow side wall and the pulling tab, tearing notches are punched into the cardboard and into the applied foil, in continuation of the lines of tearing perforations, thereby simplifying the initial tearing. According to an advantageous embodiment, the lines of tearing perforations are provided parallel to and spaced from the scoring which extends in the longitudinal direction in the basic surface area of the lid. Another advantageous variation entails that the lines of tearing perforations are arranged directly in the scoring which extends in the longitudinal direction, and are directed, shortly upstream of the corner regions, to bypass the corner regions via inclined sectors and via the transversely extending scoring into the connected narrow side wall.

A particularly advantageous embodiment is characterized in that a gripping tab, by means of which the opening of the pull-up window is simplified, is arranged on a side wall of the folded box body adjacent to the pulling tab of the lid. In order to tear open the packaging, the pulling tab and the gripping tab are pulled away from each other in opposite directions, which is facilitated by the peeling layer of the lid. The advantage hereof is that it is more readily possible to apply the forces exerted for pulling the pulling tab upwardly, because it is possible for the packaging to be held more securely via the gripping tab.

A particularly simple method of producing such packaging is characterized by the following steps:

a) producing a cardboard sheet comprising a plurality of lid blanks produced in one sheet, each lid comprising a basic surface area, four appended lateral surfaces and four punched-out corner regions, b) applying a plastics foil to the entire sheet, also in the region of the punched-out corner regions, c) scoring and punching-out the individual lid blanks, d) folding over the four side walls through 90° and sealing the lid into the folded box body, wherein the plastics foil which covers the four corner regions of the lid is tightly sealed to the folded box body.

In order that, in a lid comprising tearing perforations, the latter do not detract from the tightness of the lid, said perforations are preferably also punched in during step a), i.e. prior to the application of the plastics foil. The layer of thermoplastics plastics material is preferably applied to the cardboard blank of the folded box body and/or the cardboard blank of the lid in an extrusion process.

The filling of such a packaging is preferably carried out such that the folded box body, which has already been sealed or glued at the longitudinal overlapping seam, is set upright and the prepared lid is sealed or glued in, whereupon the bulk goods are fed into the packaging which has been inverted (lid facing downward), with the folded box body subsequently being sealed or glued at the feed opening.

Further advantageous embodiments of the invention are set out in the further subordinate claims.

The invention will be described in more detail hereinafter by way of exemplified embodiments and with reference to the attached drawings, in which.

Figure 1:
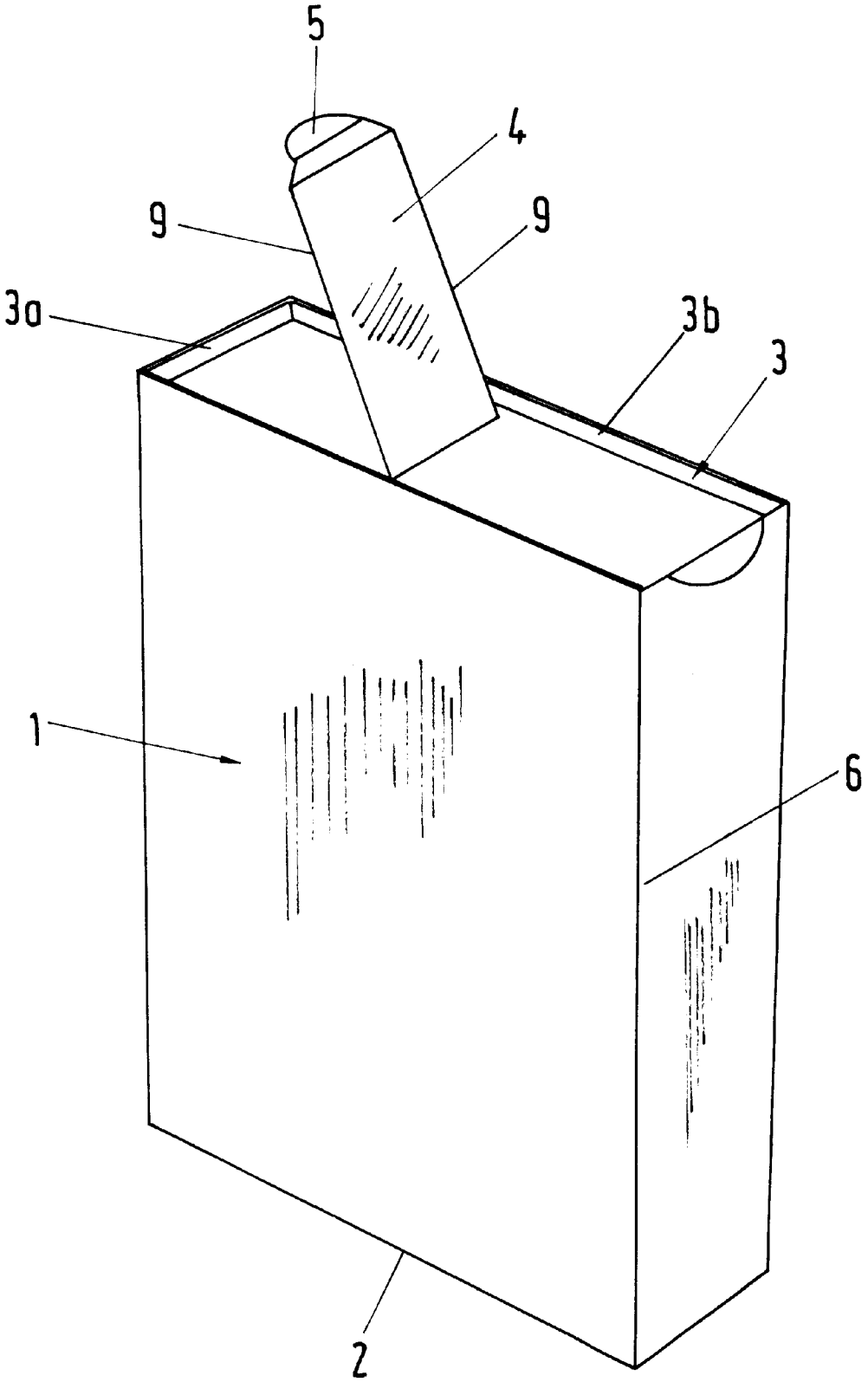
FIG. 1 is a view in perspective of an opened packaging according to the present invention.

The packaging which is illustrated in a general view in FIG. 1 comprises a folded box body 1 which is sealed at the bottom 2 (see FIG. 2), and at the upper end of which a lid 3 is placed in position in a frame-like manner. The lid 3 comprises a pull-up window 4, such that it is possible for the content of the packet to be discharged and the packaging to be closed again by tilting the pull-up window in a downward direction.

Figure 2:
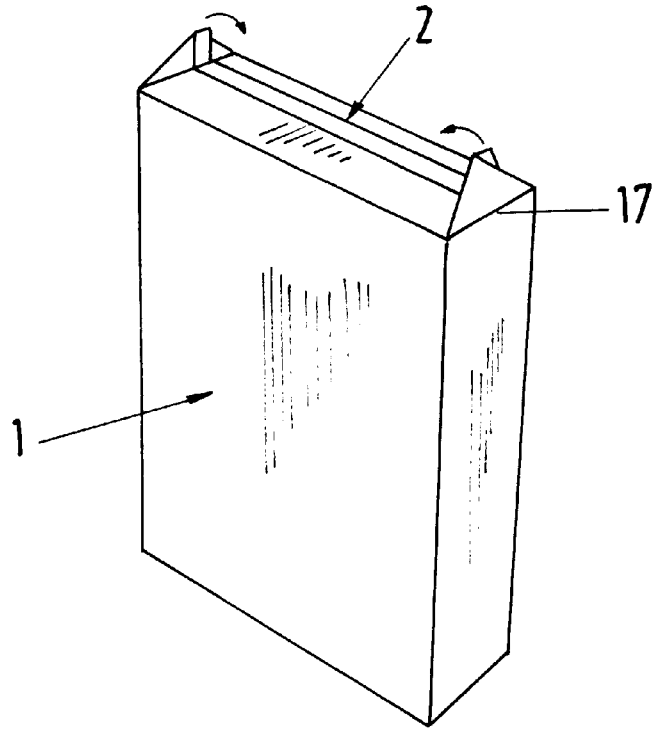
FIG. 2 is a view in perspective of an inverted packaging illustrating the lower seal.
Figure 3:
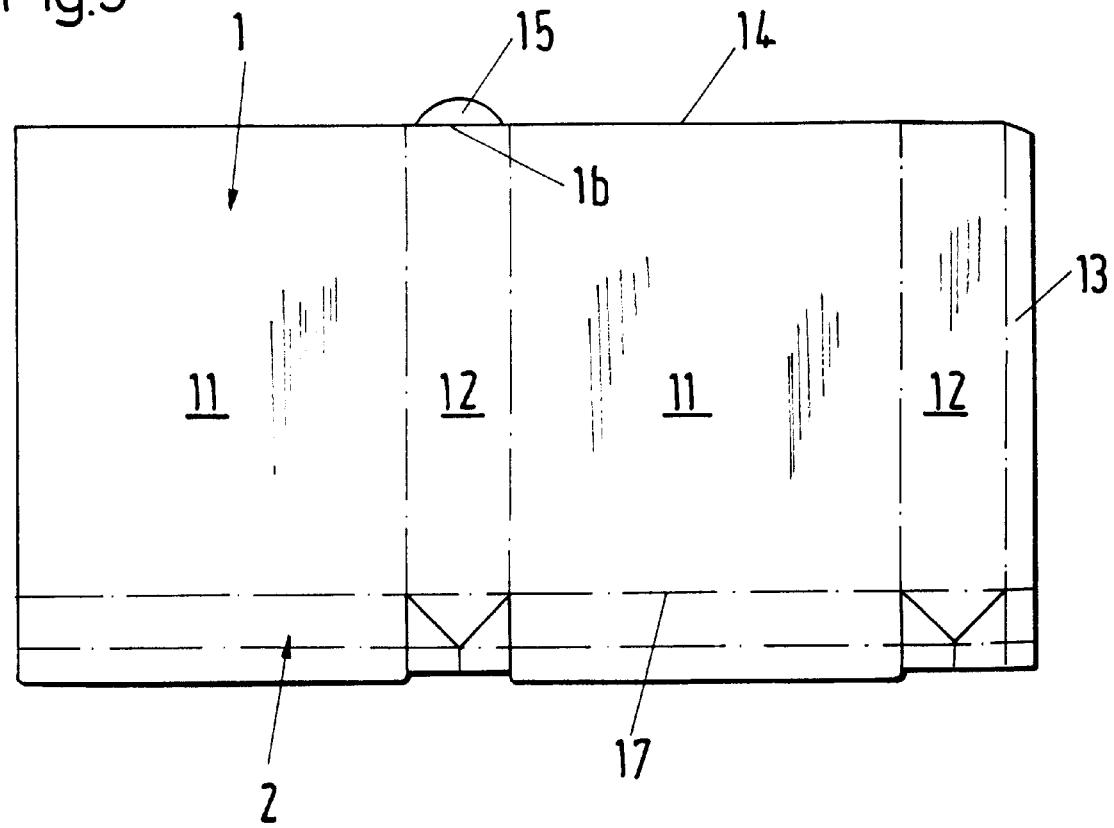
FIG. 3 shows a cardboard blank for the folded box body of the packaging.

The folded box body 1 is produced from a cardboard blank according to FIG. 3 from a cardboard which is coated with a sealing layer, in particular a thermoplastic foil. The cardboard blank according to FIG. 3 comprises two front faces 11 and two side faces 12 which are defined with respect to one another by means of scoring. The cardboard blank is joined together by means of an overlapping surface 13, which is shaped thereon, to form a folded box body 1 with the formation of a longitudinal overlapping seam 6. The feed opening, which is required for the filling procedure and which is sealed after filling, is disposed at the (lower) end 2 of the folded box body 1. This seal is shown in FIG. 2 and is known per se.

Prior to filling the packaging with bulk goods, however, the lid 3 is fitted into the (upper) end 14 of the folded box body 1 and is tightly sealed or glued. As can be seen, in particular in FIGS. 4 and 5, the lid 3 comprises a cardboard blank having a basic surface area 3*c* and lateral surfaces 3*a* and 3*b* which are connected to the basic surface area 3*c* via scoring 4*a* and 4*b*, and are adapted to be folded upward through 90° relative to the lid surface. Once the lid blank (see FIG. 5) has been prepared by punching out the corner regions and punching in all the tearing perforations (which will be described in more detail hereinafter), a thermoplastic foil is applied on to the prepared cardboard blank, the foil also covering the corresponding corner regions 7 between the lateral surfaces 3*a* and 3*b*. Mention must be made of the fact that, of course, a plurality of lid blanks are produced next to one another on one sheet in order to provide a plurality of lid cutouts, such that, initially, the individual lid blanks are interconnected via their lateral surfaces 3*a* and 3*b*. Once the thermoplastic foil has been applied, the individual lid blanks are scored in a further punching operation, and are then separated from one another.

Figure 4:
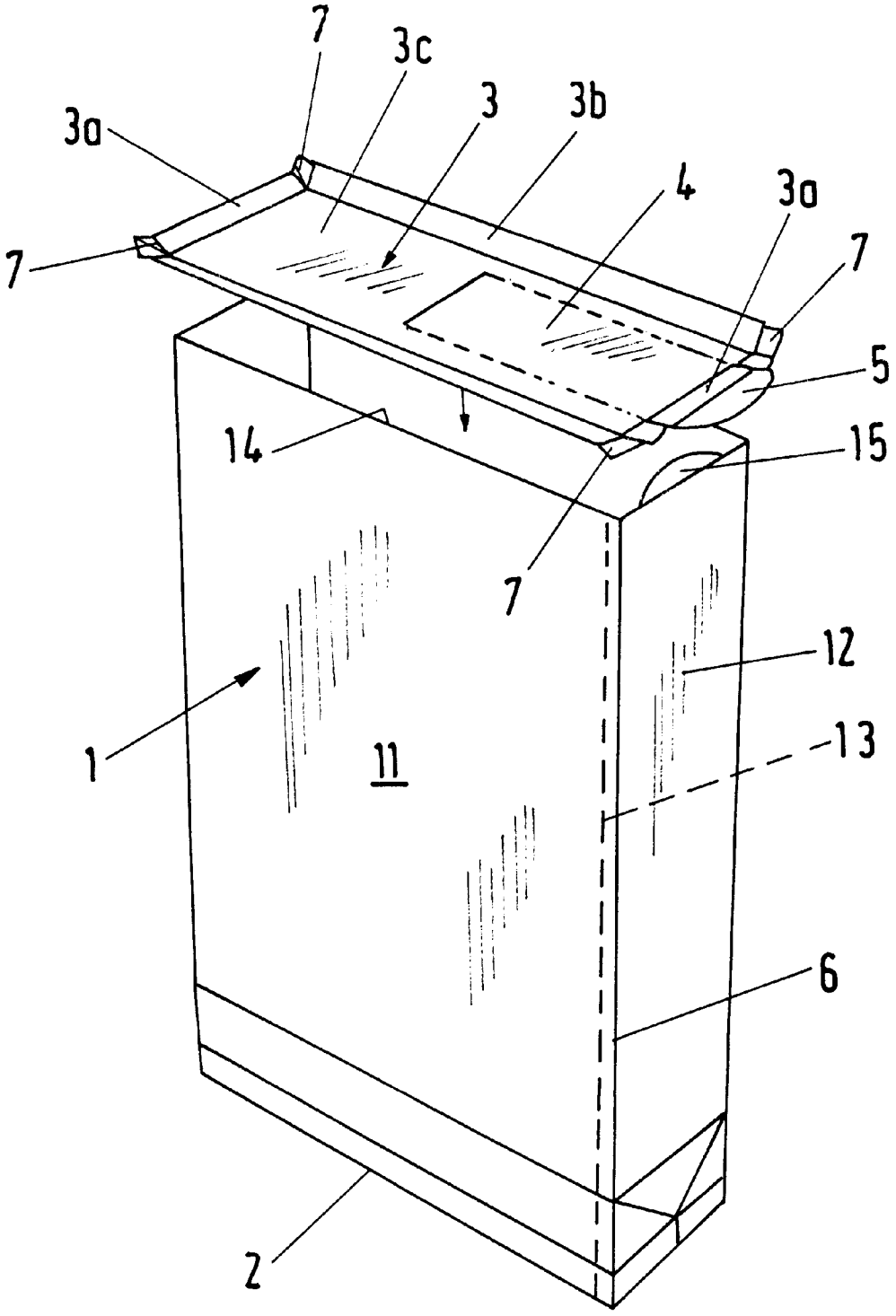
FIG. 4 shows in perspective an extended folded box body with the lid disposed above and ready for sealing.

A prepared lid cutout of this kind, comprising an applied thermoplastic foil, is now prepared for being placed in position into the upper end 14 of the folded box body, by upwardly tilting, through 90° relative to the basic surface area 3*c*, the lateral surfaces 3*a* and 3*b* which form the side walls, in which regard see FIG. 4. It can be seen that it is possible for the foil regions covering the corner regions 7 to yield in an outward direction, without any interruptions in the foil material in the corner region 7 which would subsequently lead to lack of tightness. Once the lid 3 has been pushed into the upper end 14 of the folded box body 1, the four side walls 3*a* and 3*b* are sealed or glued to the inner surface of the upper end 14 of the folded box body 1, the bridging foil material in the corner regions 7 ensuring a reliable seal in the corner regions. In a second sealing operation, it is possible for the corners of the lid 3 to be locked securely, using rounded-off tools.

Thus, once the lid 3 has been sealed or glued into the upper end 14 of the folded box body 1, the packaging is inverted, such that the feed opening at the (previously lower) end 2 is available for bulk goods to be filled into the packaging. When the packaging has been filled with bulk goods up to a scoring 17 (see FIG. 3), it is possible for the previously lower end 2 to be completed by sealing, using a seal which is known per se (see FIG. 2).

In what follows, details will be given with regard to the top opening for discharging the contained bulk goods and for resealing. As can be seen, in particular in FIG. 5, the lid 3 is provided in its basic surface area 3*c* with a pull-up window 4, which is defined by two lines of tearing perforations 9, which extend in the longitudinal direction of the lid 3 with a spacing therebetween, and by the scoring 4*a*, which connects the basic surface area 3*c* to the one side wall 3*a*, and by a further scoring 4*d* in the central region of the basic surface area 3*c*. The tearing lines 9 are disposed at a spacing from the scoring 4*b* extending in the longitudinal direction. The lines of tearing perforations 9 extend beyond the scoring 4*a* and into the adjoining side wall 3*a*, up to tearing notches 8 which have been produced there by punching. A pulling tab 5 is shaped on the ending edge of the side wall 3*a* via a further scoring 4*c*. Scoring is illustrated in the drawings in dot-dash lines, while lines of tearing perforations are shown in broken lines.

It is then possible for the lid 3, sealed into the folded box body 1, to be opened in that it is possible, by pulling the pulling tab 5 upward, for the pull-up window 4 to be torn along the tearing perforation 9 and away from the basic surface area 3*c* up to the scoring 4*d*, see FIG. 1. This tearing operation is simplified as a result of the notches 8 and as a result of the mono-axial orientation of the thermoplastic foil on the lid 3 and the longitudinal direction of the cardboard machining direction.

As is shown in FIGS. 3 and 4, the folded box body 1 is provided at its upper end 14 with a gripping tab 15 which is shaped on the side wall 12. If the side wall 3*a* of the lid 3 is provided with a peelable thermoplastic plastics foil in the region of the pulling tab 5, and if the two tabs 5 and 15 are pulled away from each other in opposite directions, it is possible for the side wall 3*a* to be separated quite simply from the inner wall of the folded box body 1, thereby simplifying the further tearing of the pull-up window 4.

Figure 5:
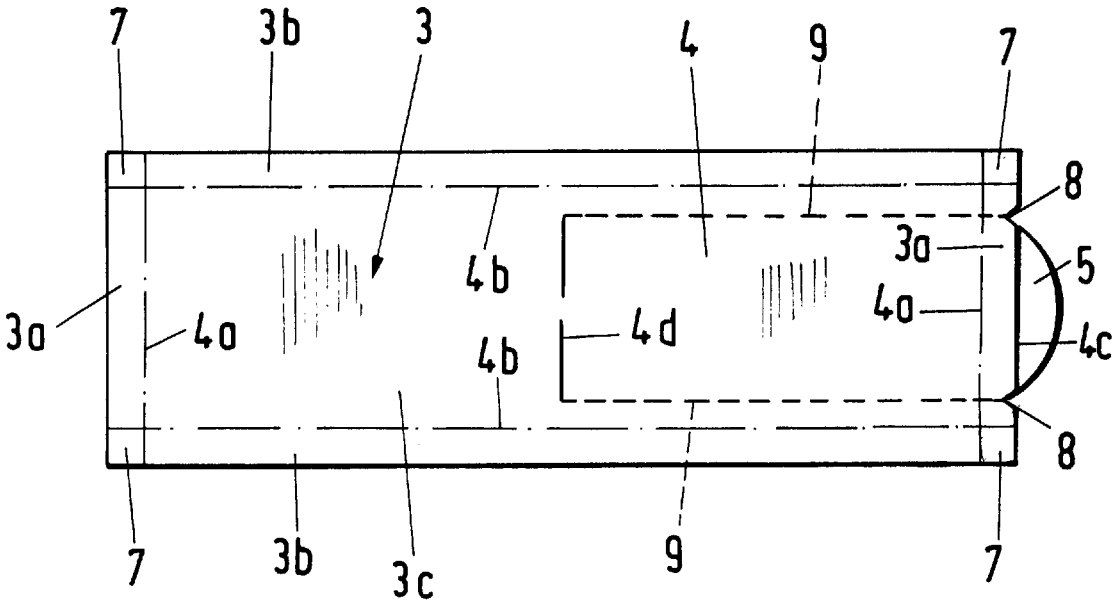
FIG. 5 shows a cardboard blank for the lid of the packaging.
Figure 6:
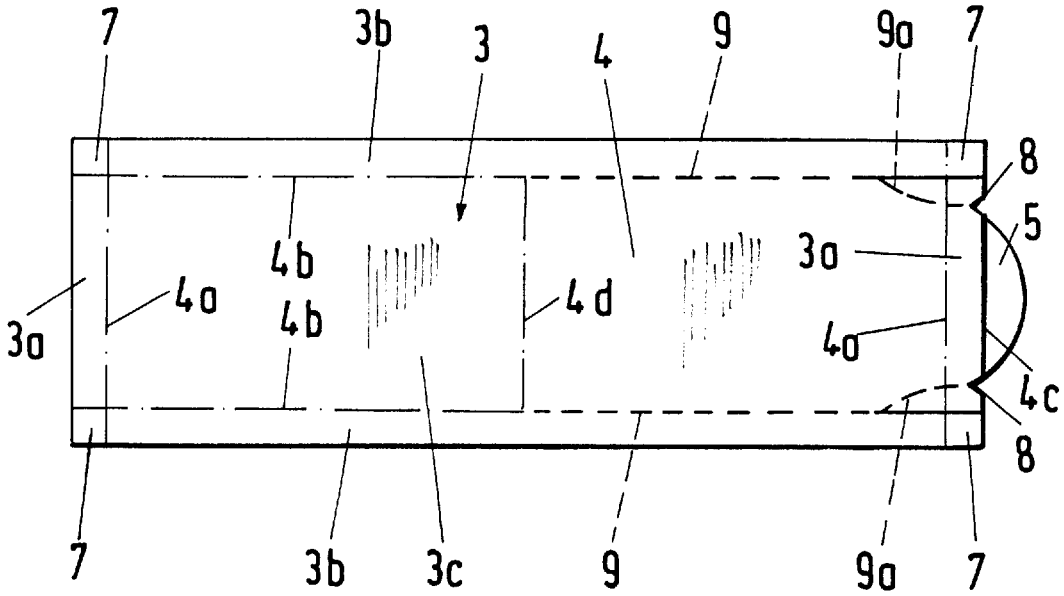
FIG. 6 shows an alternative design of a lid blank.

FIG. 6 shows an alternative embodiment to the lid 3 of FIG. 5. Relative to the embodiment according to FIG. 5, the difference in FIG. 6 is that the lines of tearing perforations 9 are provided, not at a spacing from the scoring 4*b*, but in said scoring. The advantage hereof is that the discharge opening extends across the full breadth of the packaging. The lines of tearing perforations 9 are, however, not directed into the corners of the lid 3, instead bypassing the corner regions 7 in inclined sectors 9*a*, which are also designed to have tearing perforations, and up to the tearing notches 8 on both sides of the pulling tab 5. This, in turn, again facilities the tearing operation and does not have an adverse affect on the tightness of the corner regions 7, when it is sealed into the folded box body 1.

What is claimed is:

1. Packaging for dry goods comprising a parallelepiped-shaped folded box body into which a coated lid in the shape of an elongated rectangle is integrally sealed or glued;

the folded box body comprising of a folder-box blank coated on the inside with a sealing layer of thermoplastic material and being sealed or glue-joined at an overlapping longitudinal seam;

the end of the folded box opposite the lid comprising a feed opening that extends across the entire end surface and is sealed or glue-joined after the package has been filled with the bulk goods;

the lid comprising a cardboard blank with narrow side walls connected to a base area via a scored area and having punched-out corner portions;

the base area of the lid comprising in its central portion in a transverse direction to the lid a scored area and two tear-open perforation lines starting at the ends of said scored area and extending at a distance from each other into one of the narrow side walls enclosing a pull-up window allowing the dispensing of the dry bulk goods and a subsequent closing to keep the goods fresh;

the cardboard blank for the lid being provided at its inward surface with a thermoplastic foil coating covering and sealing the previously punched-out corner portions and the tear-open perforations of the pull-up window.

2. Packaging according to claim 1, further comprising a pulling tab which is shaped on to said narrow side wall adjacent the pull-up window via an additional scoring.

3. Packaging according to claim 1, wherein the machining direction of the cardboard of the lid extends parallel to the tearing perforation.

4. Packaging according to claim 3, further comprising a pulling tab which is shaped on to said narrow side wall adjacent the pull-up window via an additional scoring.

5. Packaging according to claim 4, wherein tearing notches are punched into the cardboard and into the applied foil in continuation of the lines of tearing perforations in the region of the additional scoring between the narrow side wall and the pulling tab.

6. Packaging according to claim 4, wherein the lines of tearing perforations are provided in the basic surface area of the lid parallel to and at a spacing from the scoring which extends in the longitudinal direction.

7. Packaging according to claim 4, wherein the lines of the tearing perforations are provided in the scoring which extends in the longitudinal direction and are directed, shortly upstream of the corner regions via inclined sectors and via the transversely extending scoring into the connected narrow side wall.

8. Packaging according to claim 4, wherein a gripping tab is arranged on a side wall of the folded box body adjacent to the pulling tab of the lid.

9. Packaging according to claim 8, wherein the coating foil of the folded box body and the coating foil of the lid are made of a thermoplastic plastic material which is adapted to be sealed and is substantially impervious to humidity and atmospheric oxygen.

10. Packaging according to claim 1, wherein the coating foil of the folded box body and the coating foil of the lid are made of a thermoplastic plastic material which is adapted to be sealed and is substantially impervious to humidity and atmospheric oxygen.

11. Method of filling a packaging according to claim 1, wherein said folded box body, which is already sealed or glued at the longitudinal overlapping seam, is set upright and the prepared lid is sealed or glued in position, and bulk goods are then filled into the packaging, which is in the inverted position and the folded box body is then sealed or glued at the feed opening.

12. Method of producing a packaging which comprises a plastics-laminated folded box body and a plastics-laminated lid which is placed in position in said folded box body comprising:

a) producing a cardboard sheet comprising a plurality of lid blanks produced in one sheet, each lid comprising a basic surface area, four appended lateral surfaces, four punched-out corner regions and tearing perforations;

b) applying a plastics foil to the entire sheet including the region of the punched-out corner region, c) scoring individual lid blanks, providing two tear-open perforation lines starting at the ends of said scored area and extending at a distance from each other into one of two narrow side walls enclosing a pull-up window allowing the dispensing of the dry bulk goods and a subsequent closing to keep the goods fresh, and punching-out the individual lid blanks; and d) folding over the four side walls through 90° and sealing the lid into the folded box body, wherein the plastics foil which covers the four corner regions of the lid is tightly sealed to the folded box body.

13. Method according to claim 12, wherein the layer of thermoplastic plastic material is extruded onto at least one of the members selected from the group consisting of the cardboard blank of the folded box body and the cardboard blank of the lid.

* * * * *